US006308008B1

(12) United States Patent
Johansson et al.

(10) Patent No.: US 6,308,008 B1
(45) Date of Patent: Oct. 23, 2001

(54) IR-SOURCE WITH HELICALLY SHAPED HEATING ELEMENT

(75) Inventors: Lars-Göran Johansson; Jan Andersson, both of Hallstahammar (SE)

(73) Assignee: Kanthal AB, Hallstahammar (SE)

( * ) Notice: Subject to any disclaimer, the term of this patent is extended or adjusted under 35 U.S.C. 154(b) by 0 days.

(21) Appl. No.: 09/462,114

(22) PCT Filed: Jun. 25, 1998

(86) PCT No.: PCT/SE98/01248

§ 371 Date: Dec. 30, 1999

§ 102(e) Date: Dec. 30, 1999

(87) PCT Pub. No.: WO99/02013

PCT Pub. Date: Jan. 14, 1999

(30) Foreign Application Priority Data

Jul. 1, 1997 (SE) ..... 9702542

(51) Int. Cl.[7] ..... H05B 3/00

(52) U.S. Cl. ..... 392/427; 392/407; 219/553; 338/296; 338/299; 338/304

(58) Field of Search ..... 392/426–429, 392/425, 422, 419–421, 407, 409, 411; 338/296, 299, 304; 219/552, 270, 553

(56) References Cited

U.S. PATENT DOCUMENTS

| | | | | |
|---|---|---|---|---|
| 1,402,889 | * | 1/1922 | Potstada | 392/407 |
| 1,463,730 | * | 7/1923 | Stout | 392/422 |
| 1,516,054 | * | 11/1924 | Mottlau | 392/422 |
| 1,531,414 | * | 3/1925 | Ruben | 392/428 |
| 1,697,607 | * | 1/1929 | Maxson | 392/427 |
| 1,750,492 | | 3/1930 | Ralston . | |
| 1,762,325 | * | 6/1930 | Blair et al. | 392/422 |
| 2,068,423 | * | 1/1937 | Manser, 2d | 392/427 |
| 2,240,913 | * | 5/1941 | Roskos | 392/409 |
| 2,559,410 | * | 7/1951 | Doyle | 392/422 |
| 2,681,061 | * | 6/1954 | Modell | 392/426 |
| 3,394,257 | * | 7/1968 | Moldenhauer | 392/427 |
| 3,462,580 | * | 8/1969 | Shibata et al. | 392/411 |
| 3,812,324 | | 5/1974 | Faffaelli et al. | 219/553 |
| 4,296,311 | * | 10/1981 | Hagglund et al. | 219/542 |
| 4,711,990 | | 12/1987 | Hoshizaki et al. | 219/552 |
| 4,774,396 | * | 9/1988 | Salit et al. | 219/553 |
| 4,894,515 | * | 1/1990 | Hurko | 392/432 |
| 5,124,531 | * | 6/1992 | Ishiguro | 219/200 |
| 5,611,953 | | 3/1997 | Sekhar et al. | 219/553 |
| 6,008,479 | * | 12/1999 | Jiang et al. | 219/553 |

FOREIGN PATENT DOCUMENTS

| | | | | |
|---|---|---|---|---|
| 192522 | * | 2/1956 | (AT) | 392/426 |
| 936579 | * | 11/1973 | (CA) . | |
| 2349743 | * | 4/1974 | (DE) . | |
| 3726444 | * | 2/1989 | (DE) | 392/407 |
| 133 847 | | 3/1985 | (EP) . | |
| 432182 | * | 10/1933 | (GB) | 392/426 |
| 57-129328 | * | 8/1982 | (JP) | 392/426 |
| 5-296833 | * | 11/1993 | (JP) . | |
| 97916 | * | 5/1961 | (NL) | 392/428 |
| 7711365 | * | 5/1979 | (SE) . | |

* cited by examiner

*Primary Examiner*—John A. Jeffery
(74) *Attorney, Agent, or Firm*—Alfred J. Mangels

(57) ABSTRACT

An infrared radiation lamp that includes an electrically heated filament and a reflector. The filament is a high temperature element that is wound to a helical configuration. The helical filament is free-standing at operating temperatures, and it is positioned in an open reflector made from a ceramic material.

14 Claims, 2 Drawing Sheets

IR-SOURCE WITH HELICALLY SHAPED HEATING ELEMENT

BACKGROUND OF THE INVENTION

1. Field of the Invention

The present invention relates to an infrared radiation lamp.

2. Description of the Related Art

Different types of infrared radiation lamps are known to the art. These lamps are based on a tungsten filament or tungsten wire enclosed in a light bulb. This filament emits a large amount of infrared radiation when heated by an electric current. Such lamps, however, deliver a relatively low radiation power, for instance a power of about 1.5–2 $W/cm^2$.

There is a need to generate much higher power concentrations, and then particularly on small surfaces. For instance, there is a need to produce a power concentration of 80–90 $W/cm^2$ on a surface of only some few square centimeters in area. It has not earlier been possible to achieve such power concentrations.

There is also a need to reach such high power concentrations over larger surfaces of different configurations, such as round surfaces and elongated, rectangular surfaces, for instance. In addition to obtaining a high power concentration, there is also a need to be able to vary the power concentration over the surface concerned.

The reason why a high concentration is required is often because it is desired to heat a product rapidly during manufacture. An example of needing to rapidly heat small surfaces is found in the application of plastic caps on packaging units, where only the surface of the caps shall be quickly heated to melting temperature, for instance to a temperature of 300–400° C. An example of larger surfaces is found in the heating of wafers in electronic manufacturing processes, where the higher power shall be delivered to the peripheral parts of the wafer as opposed to the central part thereof.

The present invention satisfies the requirement of a high power concentration in respect of infrared radiation lamps.

The present invention is not restricted to any particular use, and can be applied in many different fields.

SUMMARY OF THE INVENTION

The present invention thus relates to an infrared radiation lamp which includes a reflector and an electrically heated filament. The filament is a high temperature element which is wound to a helical configuration such that the helix will be free-standing at operating temperatures, and the helix is placed in an open reflector made of ceramic material.

BRIEF DESCRIPTION OF THE DRAWINGS

The invention will now be described in more detail with reference to an exemplifying embodiment thereof and also with reference to the accompanying drawings, in which.

DESCRIPTION OF THE PREFERRED EMBODIMENTS

Figure 1:
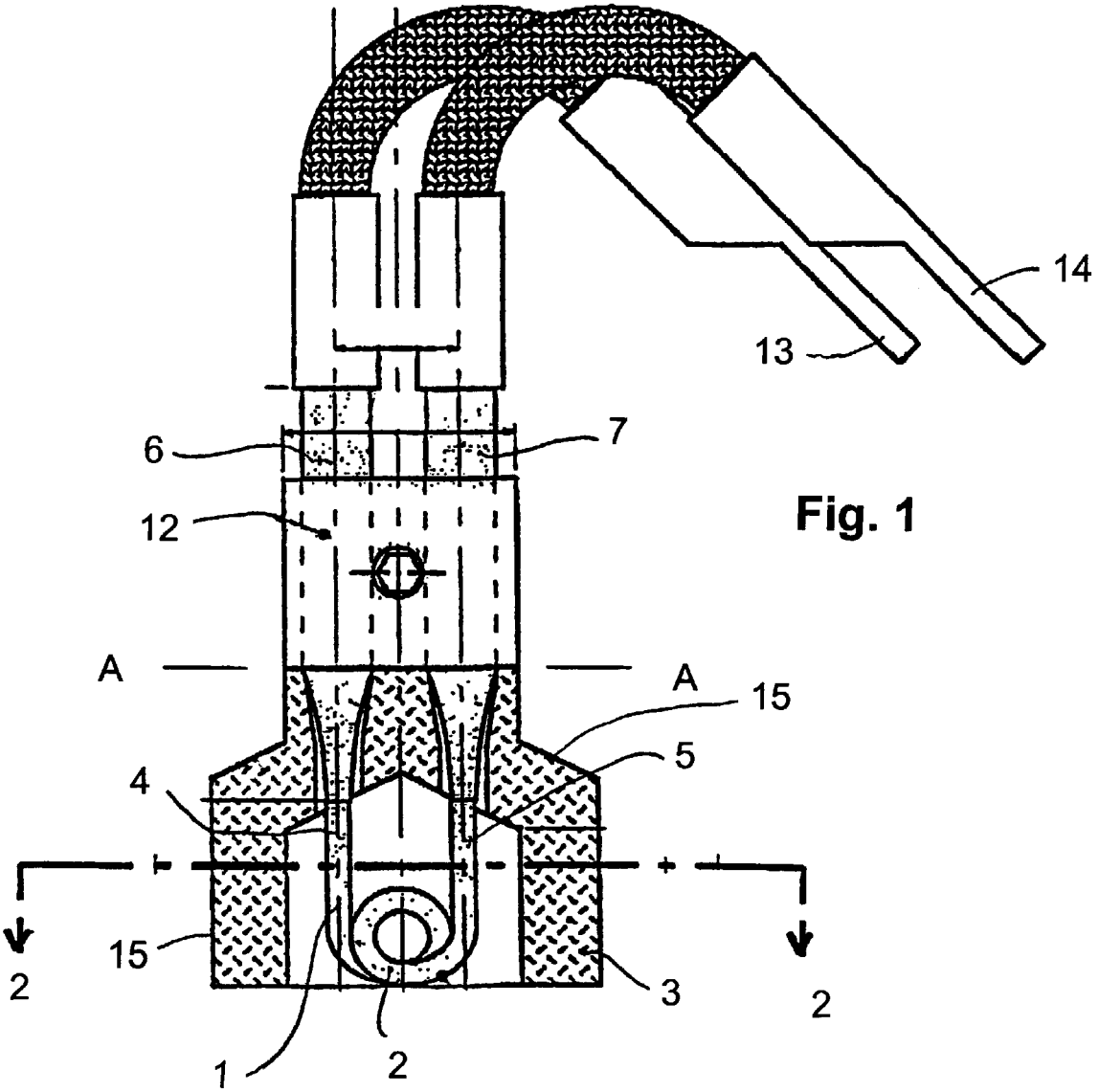
FIG. 1 is a side elevational view of a lamp in accordance with the present invention and which is shown in section below the line A—A.

The illustrated infrared radiation lamp includes a reflector and an electrically heated filament.

According to the invention, the filament 1 is a high temperature element which has been wound into a helical configuration 2, such that the helix is free-standing at operating temperatures. The helix 2 is placed in an open reflector 3 made of ceramic material. The fact that the reflector is open means that no wall will be present at the reflector opening. The helix is thus surrounded by air with adjacent turns spaced from each other.

The high temperature element is a known resistor element. Examples of such elements are those marketed by Kanthal AB under the trade names Kanthal Super 1800 and Kanthal super Excel.

Such electrical resistor elements are of the molybdenum silicide type and have long been known. They are primarily intended for use in so-called high temperature applications, primarily in conjunction with furnaces or ovens that operate at temperatures of about 1700° C.

Swedish Patent Specification 458 646 describes the resistor element Kanthal Super 1900. The material is an homogenous material with the chemical formula $Mo_xW_{1-x}Si_2$. The molybdenum and tungsten are isomorphous in this chemical formula, and can thus replace each other in the same structure.

It is preferred that the filament, or wire, has the form of a resistor element comprised of molybdenum silicide $MoSi_2$ or of a material having the chemical formula $Mo_xW_{1-x}Si_2$.

As before mentioned, an important feature of the invention is that the helix 2 is free-standing. This enables the lamp to be directed in any desired direction. In order for the helix to be free-standing, the number of turns in the helix must be limited so as to prevent the helix from becoming too heavy, e.g. top heavy. If the helix is too heavy, the straight parts 4, 5 of the filament will bend when a certain temperature is reached, unless the lamp is directed vertically downwards.

According to one preferred embodiment, the helix 2 will have at most 3.5 turns.

According to one preferred embodiment, the filament has a diameter of 1–3 mm.

The filament will preferably have an operating temperature of about 1700–1900° C. This is achieved with a known power unit that delivers 5–10 volts and a power of 300–600 W, for instance.

The lead-in wires 6, 7 may be of a molybdenum silicide type with a diameter three times larger than the diameter of the filament. The lead-in may alternatively have the form of aluminum rods that have been molded directly on the filament 1.

The reference numeral 12 in FIG. 1 identifies a holder made of a material marketed under the name Duratec. Reference numerals 13, 14 identify cable grips.

According to one preferred embodiment, the reflector is made of a ceramic fiber material, such as $A1_2O_3$. However, the reflector may, alternatively, be made of any appropriate material capable of withstanding the temperatures in question. The outer surface 15 of the reflector will preferably be coated with a reflective material 16, so as to reduce radiation losses from the lamp.

Figure 2:
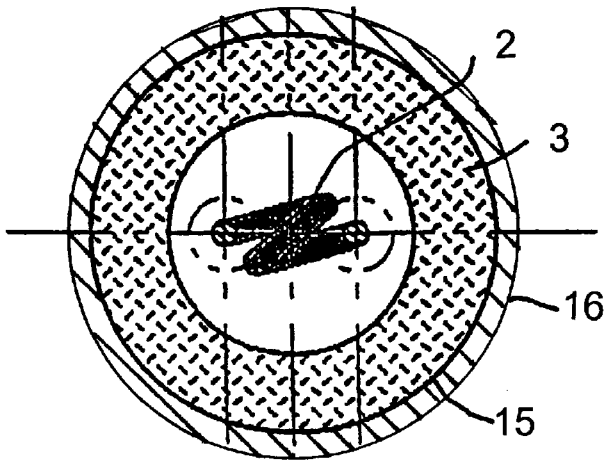
FIG. 2 is a sectional view taken on the line 2—2 in FIG. 1.
Figure 3:
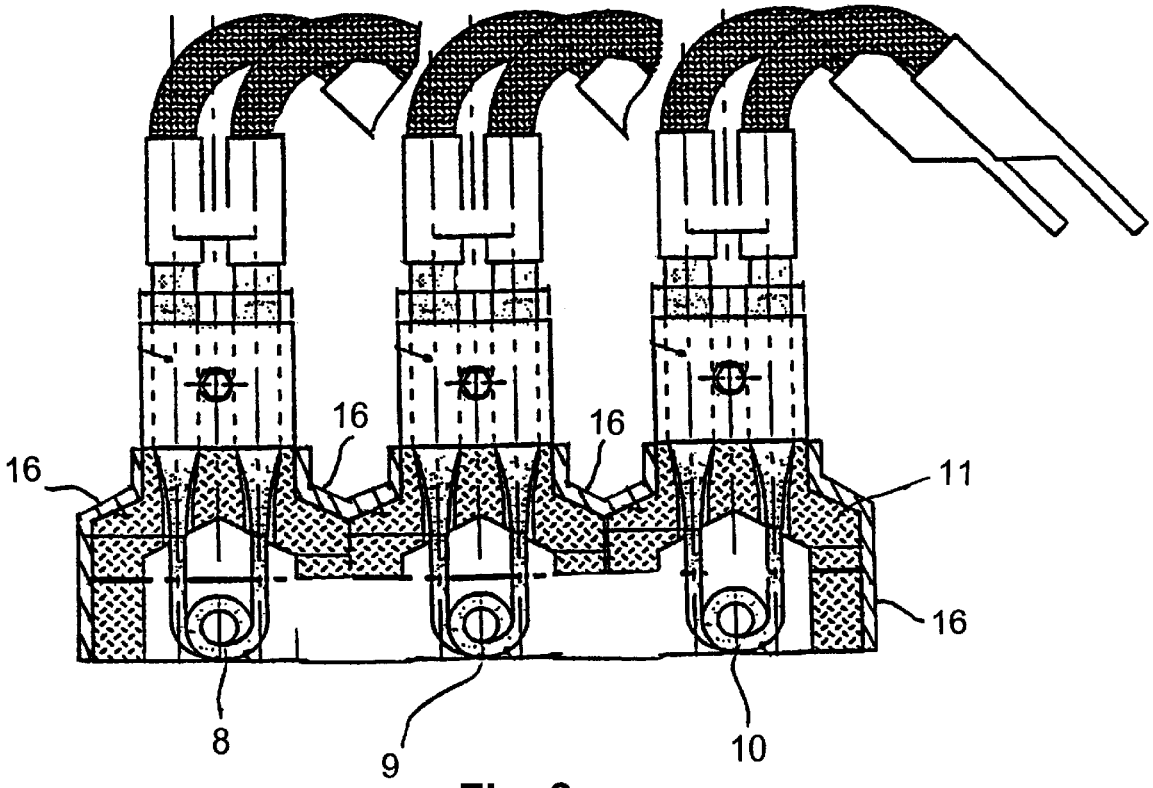
FIG. 3 is a view corresponding to the view of FIG. 1, but showing three lamps mutually combined to form a unit.

In the case of the embodiment shown in FIGS. 1 and 2, only one helix 2 is present in the reflector. However, two or more helices 8, 9, 10 may be mounted in one and the same reflector 11, as illustrated in FIG. 3. The reflector may, of course, be of different designs to suit different lamp applications. The number of helices may also be varied in accordance with lamp application.

It can be mentioned by way of example that a lamp intended to heat small surfaces to a high temperature, as mentioned in the introduction, may include a reflector that has an opening diameter of 30 mm. Such a reflector may have a wall thickness of 20 mm. The reflector may, of course, be much larger in the case of other applications.

It will be obvious that the inventive lamp satisfies the need for high power concentration mentioned in the introduction.

Although the invention has been described with reference to a number of exemplifying embodiments thereof, it will be understood that the person skilled in this art will be capable of modifying the described embodiments in accordance with the use range of the lamp.

The present invention shall not therefore be considered to be restricted to the afore described embodiments, since modifications and variations can be made within the scope of the following Claims.

What is claimed is:

1. An infrared radiation lamp comprising: an electrically heated, high temperature filament that includes molybdenum and silicon and that is made of a material having the chemical formula $Mo_xW_{1-x}Si_2$ and is wound to a helical configuration that is free-standing at operating temperatures of from about 1700° C. to about 1800° C., wherein the helical configuration includes at most 3.5 turns and is placed in an open-ended reflector made of ceramic material.

2. An infrared radiation lamp according to claim 1, wherein the filament is made from molybdenum silicide ($MoSi_2$).

3. An infrared radiation lamp according to claim 2, wherein the filament has a diameter of about 1–3 mm.

4. An infrared radiation lamp according to claim 3, wherein the filament turns are spaced from each other to define a gap therebetween.

5. An infrared radiation lamp according to claim 4, wherein the lamp has an output power concentration of from about 80 $W/cm^2$ to about 90 $W/cm^2$.

6. An infrared radiation lamp according to claim 1, wherein the reflector is made of a ceramic fiber material.

7. An infrared radiation lamp according to claim 1, wherein the filament has a diameter of about 1–3 mm.

8. An infrared radiation lamp according to claim 1, wherein the reflector has an outer surface that is covered with a reflective material to reduce lamp radiation losses.

9. An infrared radiation lamp according to claim 1, wherein the lamp includes at least two helical filaments in one and the same reflector.

10. An infrared radiation lamp according to claim 1, wherein the reflector is made from $Al_2O_3$.

11. An infrared radiation lamp according to claim 1, wherein the filament has a diameter of about 1–3 mm, and the lamp has an output power concentration of from about 80 $W/cm^2$ to about 90 $W/cm^2$.

12. An infrared radiation lamp according to claim 11, wherein the filament turns are spaced from each other to define a gap therebetween.

13. An infrared radiation lamp according to claim 1, wherein the lamp has an output power concentration of from about 80 $W/m^2$ to about 90 $w/m^2$.

14. An infrared radiation lamp according to claim 1, wherein the filament turns are spaced from each other to define a gap therebetween.

* * * * *